US011401935B2

(12) United States Patent
Schofield et al.

(10) Patent No.: US 11,401,935 B2
(45) Date of Patent: Aug. 2, 2022

(54) TWIN SHAFT PUMPS AND A METHOD OF PUMPING

(71) Applicant: Edwards Limited, Burgess Hill (GB)

(72) Inventors: Nigel Paul Schofield, Burgess Hill (GB); Stephen Dowdeswell, Cuckfield (GB)

(73) Assignee: Edwards Limited, Burgess Hill (GB)

( * ) Notice: Subject to any disclaimer, the term of this patent is extended or adjusted under 35 U.S.C. 154(b) by 102 days.

(21) Appl. No.: 16/620,957

(22) PCT Filed: Jun. 7, 2018

(86) PCT No.: PCT/GB2018/051552
§ 371 (c)(1),
(2) Date: Dec. 10, 2019

(87) PCT Pub. No.: WO2018/229459
PCT Pub. Date: Dec. 20, 2018

(65) Prior Publication Data

US 2020/0102958 A1 Apr. 2, 2020

(30) Foreign Application Priority Data

Jun. 12, 2017 (GB) ..... 1709296

(51) Int. Cl.
*F04C 18/12* (2006.01)
*F04C 23/00* (2006.01)
*F04C 25/02* (2006.01)

(52) U.S. Cl.
CPC ..... *F04C 18/126* (2013.01); *F04C 23/001* (2013.01); *F04C 25/02* (2013.01);
(Continued)

(58) Field of Classification Search
CPC ..... F04C 18/08; F04C 18/126; F04C 23/001; F04C 25/02; F04C 29/12; F04C 2210/22;
(Continued)

(56) References Cited

U.S. PATENT DOCUMENTS

2012/0207638 A1 8/2012 Krampe
2015/0037187 A1* 2/2015 Turner ..... F01C 21/10 418/9

(Continued)

FOREIGN PATENT DOCUMENTS

CN 1495363 A 5/2004
CN 2656674 Y 11/2004

(Continued)

OTHER PUBLICATIONS

Translation of Office Action dated Dec. 7, 2020 received in counterpart CN Application No. 201880040102.2, 13 pp.

(Continued)

*Primary Examiner* — Audrey B. Walter
*Assistant Examiner* — Dapinder Singh
(74) *Attorney, Agent, or Firm* — Shumaker & Sieffert, P.A.

(57) ABSTRACT

A twin shaft pump may include two cooperating rotors configured to rotate in opposite directions about parallel axes of rotation; a stator comprising a stator bore in which the rotors are mounted to rotate. The stator bore includes a central part between the two axes of rotation, and an outer part outside of the two axes, the rotors being configured to have cooperating dimensions with the stator bore such that an outer edge of each rotor that is remote from the other rotor seals with the stator bore when rotating in at least a portion of the outer part. A fluid inlet is provided in the stator bore, at least a portion of the fluid inlet being in the central part of the stator bore between the axes of rotation. A fluid outlet (Continued)

is provide in an opposing surface of the stator bore, the fluid outlet being in the central part of the stator bore. The fluid inlet and fluid outlet are arranged such that on rotation of the rotors, the rotors each move a pumping chamber between the fluid inlet and the fluid outlet; wherein at least a portion of the fluid inlet is arranged to extend beyond the central part of the stator bore.

15 Claims, 2 Drawing Sheets

(52) U.S. Cl.
CPC ..... *F04C 2210/22* (2013.01); *F04C 2240/20* (2013.01); *F04C 2250/102* (2013.01)

(58) Field of Classification Search
CPC ..... F04C 2240/20; F04C 2250/101; F04C 2250/102; F05B 2210/12
See application file for complete search history.

(56) References Cited

U.S. PATENT DOCUMENTS

| | | | | |
|---|---|---|---|---|
| 2015/0277286 | A1* | 10/2015 | Mizutani | G03G 21/10 399/258 |
| 2016/0097390 | A1* | 4/2016 | Schofield | F04C 2/084 418/206.5 |

FOREIGN PATENT DOCUMENTS

| | | | |
|---|---|---|---|
| CN | 1712708 | A | 12/2005 |
| CN | 103104489 | A | 5/2013 |
| DE | 4218855 | A1 | 12/1993 |
| DE | 102006004525 | A1 | 8/2007 |
| EP | 1398509 | A2 | 3/2004 |
| GB | 856706 | | 12/1960 |
| JP | 50153307 | A | 12/1975 |
| JP | 1975153307 | A | 12/1975 |
| JP | 1976063506 | U | 11/1976 |
| JP | S62121887 | A | 6/1987 |
| JP | 2011202535 | A | 10/2011 |
| JP | 2015509165 | A | 3/2015 |

OTHER PUBLICATIONS

Written Opinion and the International Search Report dated Aug. 10, 2018 in counterpart International Application No. PCT/GB2018/051552, 13 pp.

Combined Search and Examination Report under Sections 17 and 18 (3) dated Nov. 9, 2017 in counterpart GB Application No. 1709296.6, 7 pp.

Translation of Notification of Reason for Rejection from counterpart Japanese Application No. 2019-568689 dated Mar. 22, 2022, 7 pp.

* cited by examiner

TWIN SHAFT PUMPS AND A METHOD OF PUMPING

This application is a national stage entry under 35 U.S.C. § 371 of International Application No. PCT/GB2018/051552, filed Jun. 7, 2018, which claims the benefit of GB Application 1709296.6, filed Jun. 12, 2017. The entire contents of International Application No. PCT/GB2018/051552 and GB Application 1709296.6 are incorporated herein by reference.

TECHNICAL FIELD

The disclosure relates to twin shaft pumps.

BACKGROUND

Twin shaft pumps operate on a cooperating rotor principle, where two rotors rotate in opposite directions and pumping chambers formed between the rotors and stator bore are moved between the gas inlet and gas outlet. In order to avoid back flow of gas between the inlet and outlet, the rotors are generally configured such that the pumping chamber is sealed from the inlet before it is opened to the outlet. This requirement limits the size of these openings.

The rate of flow or capacity of a pump can be increased either by increasing its size or by increasing its speed of rotation. Increasing the size of a pump increases material costs and limits its applications. In general there is a desire to reduce the size of pumps to reduce material usage and the cost of transport and footprint when installed. Increasing the speed of rotation does not have the same disadvantages as size increase however, there is a limit to the amount that a rotational speed of a pump can be increased. Limiting factors include material strength and the ability to get the fluid to be pumped into and out of the pump. If a conventional twin shaft pump is run faster, then it has been found that beyond a certain speed there is not a corresponding increase in flow rate or capacity.

It would be desirable to provide a twin shaft pump with a small size and high capacity.

SUMMARY

A first aspect provides a twin shaft pump comprising: two cooperating rotors configured to rotate in opposite directions about parallel axes of rotation; a stator comprising a stator bore in which said rotors are mounted to rotate; said stator bore comprising a central part between said two axes of rotation, and an outer part outside of said two axes, said rotors being configured to have cooperating dimensions with said stator bore such that an outer edge of each rotor that is remote from the other rotor seals with said stator bore when rotating in at least a portion of said outer part; a fluid inlet in said stator bore, at least a portion of said fluid inlet being in said central part of said stator bore between said axes of rotation; a fluid outlet in an opposing surface of said stator bore, said fluid outlet being in said central part of said stator bore; said fluid inlet and fluid outlet being arranged such that on rotation of said rotors, said rotors each move a pumping chamber between said fluid inlet and said fluid outlet; wherein at least a portion of said fluid inlet is arranged to extend beyond said central part of said stator bore.

The inventor of the present recognized disclosure that a limiting factor when increasing the speed of a pump is the inlet conductance or flow rate of fluid into the pump. In effect beyond a certain speed the inlet conductance prevents the performance increasing in proportion to the increase in shaft speed. The location and size of fluid inlets in twin shaft pumps has conventionally been constrained by their mode of operation. In this regard, twin shaft pumps operate by a pumping chamber defined by the rotor and stator bore moving gas between a fluid inlet and fluid outlet as the rotor rotates. In order to effectively pump the gas, the pumping chamber should be sealed from the gas inlet when in fluid communication with the exhaust. Thus, conventionally the size of the gas inlet is limited to not extend beyond the rotor axes. Thus, at the top dead centre position the rotor conventionally seals both the inlet and outlet from a pumping chamber defined between the rotor and the stator bore. Prior to the top dead centre position the inlet is open to the pumping chamber while beyond it the gas outlet is open to the pumping chamber.

In order to improve inlet conductance the inventor recognised that increasing the size of the inlet such that it extends beyond the usual limit to its size, that is beyond the axes of rotation, would provide not just an increase in area for any fluid to be input to the pump but also an increase in time for the fluid to be input, as the increase in size provides a delay to the inlet being sealed from the pumping chamber.

There is a technical prejudice in the field for increasing an inlet beyond the rotational axes as it can lead to a fluid flow path between the inlet and outlet which is generally detrimental to pump performance. However, the inventor also recognised that owing to compression of the gas during pumping, the fluid outlet did not need to be the same size as the fluid inlet and thus, problems with the fluid flow path between the outlet and inlet could be mitigated by providing an outlet that did not extend beyond the central part in the same way as the inlet did. Furthermore, in some circumstances such as operation at high speed, it may be acceptable for the inlet and outlet to both communicate with the pumping chamber for a portion of the rotation of the rotors, as at high rotational speeds, this would be a brief period and due to latency and prevailing flow directions, problems associated with fluid flow from outlet to inlet could be avoided or at least mitigated.

Thus, a fluid inlet which extends beyond the central part of the pump such that it is no longer sealed at top dead centre position is proposed in conjunction with a fluid outlet which is within the central position. The fluid outlet can be smaller than the fluid inlet and yet not be detrimental to performance owing to the compression of the fluid by the pump.

The fluid may be a gas, a vapour, or a gas and vapour mixture.

In some embodiments, said fluid inlet is arranged to extend beyond said central part such that an outer edge of each of said rotors starts to seal with said stator bore beyond said fluid inlet when at an angle of rotation of between 5° and 25° after a top dead centre position, said top dead centre position being a rotor position where a diameter of said rotor is perpendicular to a line joining said axes of rotation.

It has been found that a particularly advantageous increase in size of inlet and corresponding delay in closing the inlet is one where the inlet is sealed between 5° and 25° after the top dead centre position, preferably between 10° and 20°. This provides an effective improvement in inlet conductance while still allowing effective pumping operations.

In some embodiments, said fluid inlet is symmetrical about a plane mid-way between said axes of rotation, and is arranged such that said fluid inlet extends beyond said central part on both sides.

Although the gas inlet could be enlarged only on one side, it may be advantageous for the pumping provided by both rotors to be substantially the same and for the fluid inlet to be arranged symmetrically.

In some embodiments, said fluid outlet is arranged such that it is completely within said central part.

In some embodiments, said fluid outlet is configured such that it smaller than said fluid inlet.

In some embodiments, said fluid inlet and fluid outlet are arranged such that said outer edge of each of said rotors starts to seal with said stator bore beyond said fluid inlet as an opposing outer surface of each of said rotors moves beyond an edge of said fluid outlet, such that said pumping chambers between said stator bore and said rotors are sealed from said fluid inlet and brought into fluid communication with said fluid outlet in synchronisation.

Although the fluid inlet may be enlarged and the fluid outlet remain unchanged, in some embodiments, it may be preferable to alter the size of the two in a corresponding manner, such that the angular delay between the opening and closing of the two ports is aligned. That is there is both a delay to seal the inlet and a corresponding delay to open the outlet, such that the opening and closing of the outlet and inlet is synchronised for the pumping chambers and there is no direct flow path through the pumping chambers from the outlet to inlet.

In other embodiments, said fluid outlet and fluid inlet are arranged such that said opposing outer surface of each of said rotors moves beyond an edge of said fluid outlet prior to said outer surface of said rotor sealing with said stator bore beyond said fluid inlet, such that said pumping chamber between said stator bore and said rotor is in fluid communication with both said fluid inlet and said outlet for a fraction of each rotor rotation.

As noted previously, although a path between fluid outlet and fluid inlet can be disadvantageous, there are circumstances where it may be acceptable, in particular for high speed operation. Where the overlap is of a limited size, then the latency and prevailing fluid flow direction may be sufficient to suppress any back flow of fluid from outlet to inlet and render this overlap acceptable.

In some embodiments, said fluid outlet is arranged such that during rotation said rotor moves beyond an edge of said fluid outlet bringing one of said pumping chambers into fluid communication with said fluid outlet when at an angle of rotation of between 5° and 20° beyond a bottom dead centre position, said bottom dead centre position being where a diameter of said rotor is perpendicular to a line joining said axes of rotation.

Preferably, said angle is between 5° and 15° beyond a bottom dead centre position.

The reduction in size of the fluid outlet should not be too great otherwise performance will suffer. However, the angle delay can be up to 20° although preferably less than 15°.

Although the fluid outlet could be reduced in size, by moving just one edge and delaying the opening of the outlet for one rotor, in some embodiments, said fluid outlet is symmetrical about a plane mid-way between said axes of rotation providing a symmetric operation for the two rotors.

Although the pump may have different forms such as a single stage claw pump, preferably, said pump comprises a twin shaft roots pump.

Roots pumps are well adapted for high speed operation and the provision of such a pump with an increased fluid inlet can enable increases in the speed of operation to translate to increases in pump capacity.

In some embodiments said pump comprises a pump configured for high speed operation.

High speed operation brings with it associated difficulties, inlet conductance on occasions being a limiting factor to increased performance. Increasing the gas inlet size and time that it is open for can help address this and if a correspondingly reduced gas outlet is used problems with backflow can be mitigated. With high speed operation then the reduction in gas outlet size does not need to match gas inlet size, as some overlap of the two ports being open may be acceptable owing to the high speed of operation and the corresponding low time period of such overlap.

In some embodiments, high speed operation is operation between 5,000 and 18,000 RPM, preferably, between 8,000 and 18,000 RPM, more preferably between 10,000 and 18,000.

In some embodiments, high speed operation comprises a velocity of a tip of said rotor of between 60 and 120 m/s, preferably between 80 and 120 m/s, more preferably between 80 and 100 m/s.

Although embodiments work well for a single stage pump, they are also effective for multi-stage pumps, where fluid output through the fluid outlet is fed to the fluid inlet of the next stage.

A second aspect of the present disclosure provides a method of high speed pumping comprising: rotating two cooperating rotors of a twin shaft roots pump in opposite directions at a rotational speed greater than 5,000 RPM, rotation of said rotors each moving a respective pumping chamber between a fluid inlet and a fluid outlet; starting to seal said pumping chambers from a fluid inlet when respective rotors move beyond an angle of between 5° and 25° after a top dead centre position, said top dead centre position being a rotor position where a diameter of said rotor is perpendicular to a line joining said axes of rotation; and starting to open said pumping chambers to a fluid outlet when respective rotors move beyond 5° and 20° of a bottom dead centre position, said bottom dead centre position being where a diameter of said rotor is perpendicular to a line joining said axes of rotation.

Advantageously the method is such that the closing and opening of the inlet and outlet occur at approximately the same time, or the outlet is opened slightly earlier than the inlet is closed.

Further particular and preferred aspects are set out in the accompanying independent and dependent claims. Features of the dependent claims may be combined with features of the independent claims as appropriate, and in combinations other than those explicitly set out in the claims.

Where an apparatus feature is described as being operable to provide a function, it will be appreciated that this includes an apparatus feature which provides that function or which is adapted or configured to provide that function.

BRIEF DESCRIPTION OF THE DRAWINGS

Embodiments of the present disclosure will now be described further, with reference to the accompanying drawings.

DETAILED DESCRIPTION

Before discussing the embodiments in any more detail, first an overview will be provided.

To enable a twin shaft pump such as a roots blower to operate effectively at high tip speeds improved inlet conductance to the rotors is provided. This is achieved in embodiments by increasing the size of the inlet and thereby delaying the closing of the inlet, and in some cases correspondingly delaying the opening of the exhaust. The inlet may be delayed by more than the exhaust, so that in some embodiments both are open for a brief time. This may be acceptable for high speed operation where due to the high rotor speeds, the exhaust fluid is unable to reach the inlet during the brief period that they are both open.

Figure 1:
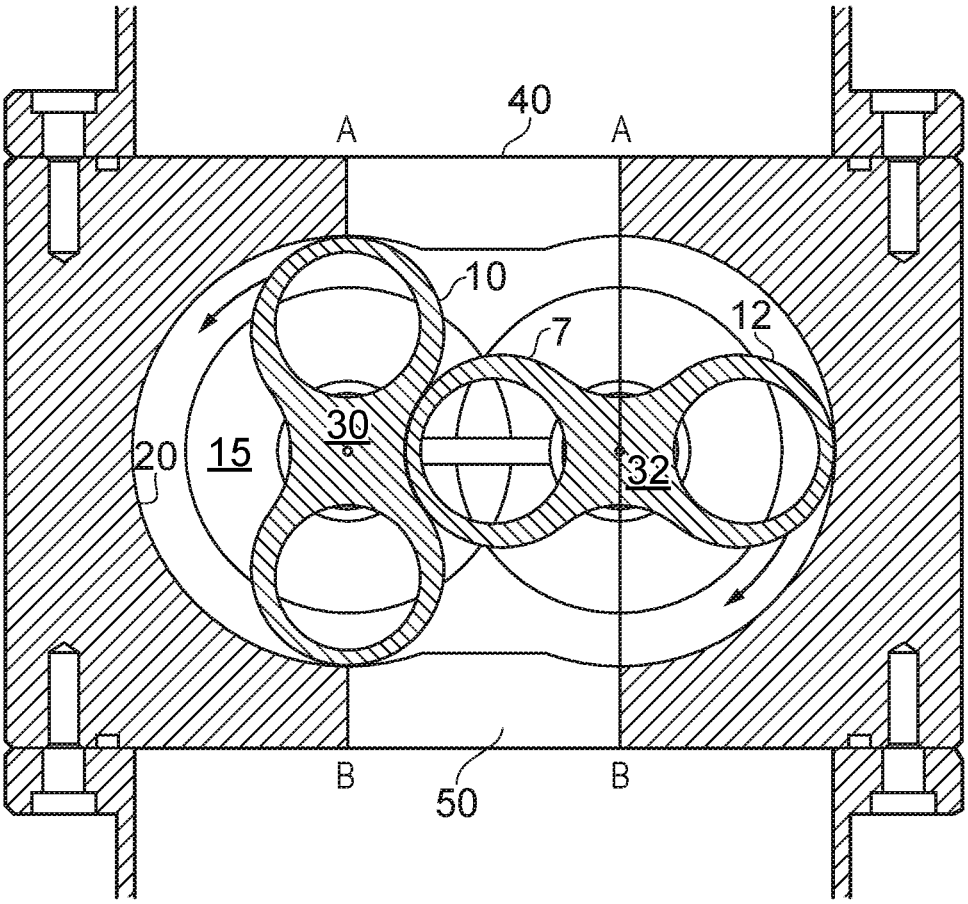
FIG. 1 illustrates a twin shaft roots pump according to the prior art.

FIG. 1 shows a twin shaft roots pump according to the prior art. The twin shaft roots pump according to the prior art has two rotors 10 and 12, operable to rotate about parallel rotational axis 30 and 32 within a stator bore 20. Gas inlet 40 and gas outlet 50 are configured such that the edges align with the axes of rotation 30, 32, such that the point of transition between the inlets and outlets being open is the top dead centre A or bottom dead centre B positions of each rotor. Rotor 10 is shown in this position and in this position pumping chamber 15 between rotor 10 and stator bore 20 is sealed from both the inlet 40 and the outlet 50. Further rotation of the rotor in the anti-clockwise direction moves the pumping chamber 15 around to the gas outlet 50 where gas is expelled. During this rotation gas is sucked in via inlet 40 and is itself captured within a new pumping chamber 15 when the rotor 10 has moved through 180 degrees; at this point rotor tip seals just beyond the fluid inlet 40. In this way, gas is moved from the inlet 40 to the outlet 50. Rotor 12 rotates in the opposite clockwise direction and moves gas in a corresponding way.

Although conventional twin shaft roots pumps are able to operate at relatively high speeds, when the speed is increased beyond a certain amount it has been found that there is not a corresponding increase in capacity. The inventor determined that this was due to problems with supplying enough gas at the inlet. In effect inlet conductance of a conventional pump is not able to supply gas at a sufficient rate for the increased pumping speeds. Embodiments of the disclosure have addressed this by providing a pump such as that shown in FIG. 2.

Figure 2:
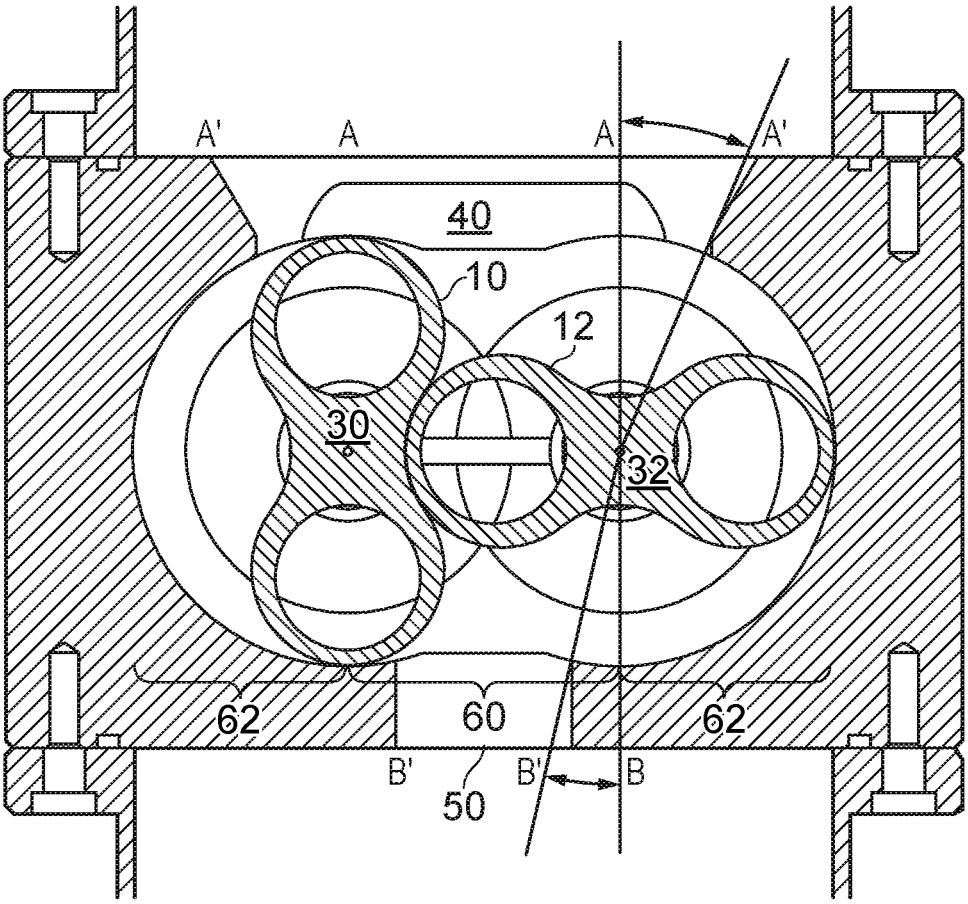
FIG. 2 illustrates a twin shaft roots pump according to an embodiment.

FIG. 2 shows a pump according to an embodiment. The pump of FIG. 2 is similar to the prior art pump of FIG. 1, but the gas inlet 40 has been extended beyond the central part 60 of the stator bore that lies between the rotational axes 30, 32 into the outer parts 62 of the stator bore, which lie beyond these rotational axes 30, 32. This increase in gas inlet size provides a corresponding delay in closing the inlet and allows additional gas to be swept into the pump as the rotors rotate, providing increased inlet conductance and alleviating the limiting factor for increasing capacity with increasing rotational speed.

Owing to this increase in the gas inlet size when the rotor is in the top dead centre position A as is shown for rotor 10, then at this point the inlet is open, that is there is no seal between the stator bore 20 and rotor 10, such that pumping chamber 15 is in fluid communication with inlet 40. In effect, there is an inlet delay A-A' of a few degrees of rotation before the rotor 10 seals with the stator bore 20 when compared to the pump of FIG. 1.

As can be envisaged if the exhaust were the same size as a conventional exhaust then there would be some rotational angles where the pumping chamber is in fluid communication with both the gas inlet 40 and the gas outlet 50. In this embodiment, in order to mitigate against this, the exhaust 50 has also been provided with a rotational delay B-B' in closing, in this case by decreasing its size. Thus in the bottom dead centre position B, rotor 12 has not yet reached the exhaust or gas outlet and thus still seals with the stator bore 20 such that pumping chamber 15 is not at this point in fluid communication with the gas outlet 50. Once rotor 10 has rotated a little further beyond the angle of the exhaust delay B-B', then gas outlet 50 will start to be opened by the rotor 12 and pumping chamber 15 will be in fluid communication with it. If the inlet and exhaust delays are matched, then the closing of the inlet will be synchronised with the opening of the exhaust and the pumping chamber will be sealed for a moment such that the inlet and outlet are not in fluid communication via the pumping chamber 15. However, in some embodiments and indeed in this embodiment, the exhaust delay B-B' is made to be smaller than the inlet delay A-A' such that there will be a brief moment when the pumping chamber 15 is in fluid communication with both the inlet 40 and the exhaust 50.

An advantage of not matching the inlet and exhaust delay is that the gas outlet does not need to be reduced in size by as much as the gas inlet is increased in size. Although compression of the gas during pumping does allow the exhaust to be smaller than the inlet without affecting capacity, there is a limit beyond which the reduction in the exhaust may itself become a limiting factor. Thus, having a design which allows the inlet to be increased in size by more than the outlet can be advantageous. Such a design is particularly applicable for high speed operation. As can be seen the overlap in the inlet and outlet being open occurs for a few angles of rotation of the rotor in every rotation. In high speed operation this will only occur for a short amount of time, such that the time period during which there is a fluid flow path between the inlet and outlet will be small enough that latency effects and the prevailing flow direction of the gas or fluid being pumped is sufficient to avoid any significant amount of flow between the outlet and inlet. Thus, this flow path will not be detrimental to pumping performance and the advantage of an increase in inlet size, and a lower decrease in outlet size is provided. Thus in some embodiments, the inlet delay A-A' is made to be larger than the exhaust delay B-B'.

In other embodiments, and in particular for designs that are configured to operate at lower speeds, synchronising the opening and closing of the inlet and outlet such that there is a moment where the pumping chamber 15 is sealed from both inlet and outlet and no backflow path is present, may be found to be advantageous. In such a design, the gas inlet and exhaust delays will be equal.

In summary to improve a twin shaft pump's high speed operation improved inlet conductance to the rotors is provided. Embodiments achieve this by creating a wider inlet, delaying the closing of the inlet, and allowing more time for the gas to enter the rotors and more area through which the gas can flow.

The exhaust opening may also be delayed and this results in a narrow exhaust area, however due to the compression achieved in the pump this does not result in a conductance problem. The inlet may be delayed by more than the exhaust, so both are open for a brief time. This may be acceptable at high rotor speeds, exhaust gas being unable to reach the inlet in the short time before it has closed.

Although illustrative embodiments of the disclosure have been disclosed in detail herein, with reference to the accompanying drawings, it is understood that the disclosure is not limited to the precise embodiment and that various changes and modifications can be effected therein by one skilled in the art without departing from the scope of the disclosure as defined by the appended claims and their equivalents.

REFERENCE SIGNS

10, 12 rotors
20 stator bore
30, 32 axes of rotation
40 fluid inlet
50 fluid outlet
60 central part of pump
62 outer part of pump

The invention claimed is:

1. A twin shaft pump comprising two cooperating rotors configured to rotate in opposite directions about parallel axes of rotation;

a stator comprising a stator bore in which the two cooperating rotors are mounted to rotate;

the stator bore comprising a central part between the parallel axes of rotation, and an outer part outside of the parallel axes, the two cooperating rotors being configured to have cooperating dimensions with the stator bore such that an outer edge of each rotor that is remote from the other rotor seals with the stator bore when rotating in at least a portion of the outer part;

a fluid inlet in the stator bore, at least a portion of the fluid inlet being in the central part of the stator bore between the parallel axes of rotation;

a fluid outlet in an opposing surface of the stator bore, the fluid outlet being in the central part of the stator bore;

the fluid inlet and the fluid outlet being arranged such that on rotation of the two cooperating rotors, the two cooperating rotors each move a pumping chamber between the fluid inlet and the fluid outlet;

wherein at least a portion of the fluid inlet is arranged to extend beyond the central part of the stator bore, and wherein the fluid outlet and the fluid inlet are arranged such that an opposing outer surface of each of the two cooperating rotors moves beyond an edge of the fluid outlet prior to the outer surface of the rotor sealing with the stator bore beyond the fluid inlet, such that the pumping chambers between the stator bore and each of the two cooperating rotors is in fluid communication with both the fluid inlet and the outlet for a fraction of each rotor rotation.

2. The pump according to claim 1, wherein the fluid inlet is arranged to extend beyond the central part such that an outer edge of each of the two cooperating rotors starts to seal with the stator bore beyond the fluid inlet when at an angle of rotation of between 5° and 25° after a top dead center position, the top dead center position being a rotor position where a diameter of the rotor is perpendicular to a line joining the parallel axes of rotation.

3. The pump according to claim 2, wherein the fluid inlet is arranged to extend beyond the central part such that an outer edge of each of the two cooperating rotors starts to seal with the stator bore beyond the fluid inlet when at an angle of rotation of between 10° and 20° after a top dead center position.

4. The pump according to claim 1, wherein the fluid inlet is symmetrical about a plane mid-way between the parallel axes of rotation, and is arranged such that the fluid inlet extends beyond the central part on both sides.

5. The pump according to claim 1, wherein the fluid outlet is configured such that it smaller than the fluid inlet.

6. The pump according to claim 1, wherein the fluid outlet is arranged such that during rotation the rotor moves beyond an edge of the fluid outlet bringing one of the pumping chambers into fluid communication with the fluid outlet when at angle of rotation of between 5° and 20° beyond a bottom dead center position, the bottom dead center position being where a diameter of the rotor is perpendicular to a line joining the parallel axes of rotation.

7. The pump according to claim 6, wherein the fluid outlet is arranged such that the rotor moves beyond an edge of the fluid outlet bringing one of the pumping chambers into fluid communication with the fluid outlet at an angle of rotation of between 5° and 15° beyond the bottom dead center position.

8. The pump according to claim 1, wherein the fluid outlet is symmetrical about a plane mid-way between the parallel axes of rotation.

9. The pump according to claim 1, wherein the pump comprises a roots pump.

10. The pump according to claim 1, wherein the pump comprises a high speed pump.

11. The pump according to claim 10, wherein the pump is configured for a speed of operation of between 5,000 and 18,000 RPM.

12. The pump according to claim 10, wherein the pump is configured for a maximum velocity of a tip of the rotor during operation of between 60 and 120 m/s.

13. The pump according to claim 1, wherein the pump comprises a multi-stage pump.

14. The pump according to claim 1, wherein the pump comprises a single stage pump.

15. A method of high speed pumping comprising:

rotating two cooperating rotors within a stator bore of a stator of a twin shaft roots pump in opposite directions at a rotational speed greater than 5,000 RPM, rotation of the cooperating rotors each moving a pumping chamber between a fluid inlet and a fluid outlet;

starting to seal the pumping chambers from a fluid inlet when respective rotors move beyond an angle of between 5° and 25° after a top dead center position, the top dead center position being a rotor position where a diameter of the rotor is perpendicular to a line joining parallel axes of rotation of the two cooperating rotors; and starting to open the pumping chambers to a fluid outlet when respective rotors move beyond 5° and 20° of a bottom dead center position, the bottom dead center position being where a diameter of the rotor is perpendicular to a line joining the parallel axes of rotation, wherein the fluid outlet and the fluid inlet are arranged such that an opposing outer surface of each of the two cooperating rotors moves beyond an edge of the fluid outlet prior to the outer surface of the rotor sealing with the stator bore beyond the fluid inlet, such that the pumping chambers between the stator bore and each of the two cooperating rotors is in fluid communication with both the fluid inlet and the outlet for a fraction of each rotor rotation.

* * * * *